US011612774B2

(12) United States Patent
Cho

(10) Patent No.: US 11,612,774 B2
(45) Date of Patent: Mar. 28, 2023

(54) DUAL-CHAMBER FIRE EXTINGUISHER

(71) Applicant: MTCV Inc., Gimhae-si (KR)

(72) Inventor: Beom Jun Cho, Busan (KR)

(73) Assignee: MTCV INC., Gimhae-si (KR)

( * ) Notice: Subject to any disclaimer, the term of this patent is extended or adjusted under 35 U.S.C. 154(b) by 199 days.

(21) Appl. No.: 16/928,277

(22) Filed: Jul. 14, 2020

(65) Prior Publication Data

US 2021/0016118 A1 Jan. 21, 2021

(30) Foreign Application Priority Data

Jul. 15, 2019 (KR) ..... 10-2019-0085346

(51) Int. Cl.
*A62C 35/02* (2006.01)
*A62C 35/13* (2006.01)

(52) U.S. Cl.
CPC ..... *A62C 35/023* (2013.01); *A62C 35/13* (2013.01)

(58) Field of Classification Search
CPC ..... A62C 35/02; A62C 35/023; A62C 35/20; A62C 35/13; A62C 35/58; A62C 35/68; A62C 33/00; A62C 33/04; A62C 13/76; A62C 13/78
See application file for complete search history.

(56) References Cited

U.S. PATENT DOCUMENTS 4,691,736 A * 9/1987 Kowalski ..... A62C 35/02 137/557
8,776,820 B2 * 7/2014 Jarrell ..... F16K 31/003 251/74

FOREIGN PATENT DOCUMENTS

KR 10-0791568 B1 1/2008
KR 10-0809864 B1 3/2008

* cited by examiner

*Primary Examiner* — Christopher R Dandridge
(74) *Attorney, Agent, or Firm* — LRK Patent Law Firm

(57) ABSTRACT

A dual-chamber fire extinguisher includes an upper chamber in which a high pressure compressed gas is stored together with an extinguishing agent, a lower chamber in which a high pressure compressed gas is stored, a cylinder section provided between the upper chamber and the lower chamber, the cylinder section having an injection hole and an orifice prior to the injection hole on the basis of a flow direction of the extinguishing agent, a piston section provided inside the cylinder section and operated to block or open the orifice, and a solenoid-type valve unit provided in the lower chamber and operated to discharge a high pressure compressed gas stored in the lower chamber.

9 Claims, 5 Drawing Sheets

DUAL-CHAMBER FIRE EXTINGUISHER

CROSS REFERENCE TO RELATED APPLICATION

The present application claim priority to Korean Patent Application No. 10-2019-0085346, fled on Jul. 15, 2019, the entire content of which is incorporated herein for all purposes by this reference.

BACKGROUND OF THE INVENTION

1. Field of the Invention

The present disclosure relates to a dual-chamber fire extinguisher, and more particularly, to a dual-chamber fire extinguisher that is automatically operated in response to a fire detection signal to release a fire extinguishing agent or, if necessary, can be operated manually.

2. Description of Related Art

Generally, it is desirable and required to provide a fire extinguisher or the like in preparation for a fire in a building. However, in the case of a general fire extinguisher, since the user needs to separately purchase and prepare the fire extinguisher, and a fire extinguishing agent is sprayed only when a person operates the fire extinguisher, in the event of a fire, a user should take risks, and if it is difficult to access the fire extinguisher due to flames, the fire extinguisher becomes useless.

Meanwhile, in recent years, objects to be extinguished are not limited to simple buildings or devices and records stored therein, but are increasingly diversified. This is due to the diversification and integration of accessory facilities caused by the enlargement and high-rise of buildings, so in such trend of diversification and integration of accessory facilities, it is difficult to quickly suppress fires that are concentrated in a specific area using conventional fire extinguishing equipment alone.

Accordingly, an automatic fire extinguishing device in a local-spray type has been proposed in which in the event of a fire occurring in a specific fire extinguishing object, a fire extinguishing agent is locally sprayed toward the object to rapidly extinguish a fire. The local-spray type automatic fire extinguishing device is configured to operate automatically in the event of a fire to spray fire extinguishing agents.

The local-spray type automatic fire extinguishing device is exemplified by the accumulator type fire extinguisher disclosed in Korean Patent Registration No. 10-0791568, which includes a poppet valve having an orifice and an operation part that controls the same, so that in the event of a fire occurring, a working coil operates to open an air inlet, through which the gas filled in the operation part is discharged to the outside, pushing out the poppet valve due to the pressure difference during discharge of the gas to open a spray hole.

However, in the conventional automatic fire extinguishing device having such a configuration, a part of extinguishing agent is introduced into the operation part through the orifice in the center of the poppet valve, causing great resistance to movement of the poppet valve, thereby delaying opening of a discharge passage and thus the release of the extinguishing agent.

In addition, since during the discharge of the fire extinguishing agent, after being turned 90 degrees from the poppet valve side, the fire extinguishing agent the structure is discharged to the atmosphere through an injection nozzle of a nozzle structure, i.e., a discharge part, there are problems in that the flow resistance increases in the process of discharging the fire extinguishing agent, the for the extinguishing agent to pass through the valve structure is delayed, and a restriction is followed in forming a sufficient number of injection holes on the discharge part side.

SUMMARY OF THE INVENTION

Accordingly, the present invention has been made keeping in mind the above problems occurring in the related art, and an objective of the present disclosure is to provide a dual-chamber fire extinguisher capable of initially effectively suppressing an explosive fire or the like by rapidly discharging an extinguishing agent.

Another objective is to provide an automatic fire extinguishing device having a structure capable of minimizing the flow resistance in the process of discharging an extinguishing agent, along with quicker release of the extinguishing agent, and securing a sufficient area for the formation of the injection hole to increase freedom in design of the injection hole.

A further objective is to provide a dual-chamber fire extinguisher having a structure capable of operating in a combined electric and manual manner, thereby further improving safety and convenience.

In order to achieve the above objective, according to one aspect, the present disclosure provides a dual-chamber fire extinguisher automatically operating in response to a fire detection signal to discharge and extinguish an extinguishing agent, including: an upper chamber in which a high pressure compressed gas is stored together with an extinguishing agent a lower chamber in which a high pressure compressed gas is stored; a cylinder section provided between the upper chamber and the lower chamber, the cylinder section having an injection hole for the extinguishing agent on a sidewall thereof and an orifice prior to the injection hole on the basis of a flow direction of the extinguishing agent during the discharge of the extinguishing agent a piston section provided inside the cylinder section and operated to block or open the orifice; and a solenoid-type valve unit provided in the lower chamber and operated to discharge a high pressure compressed gas stored in the lower chamber to the outside.

In a non-operating state of the valve unit, the pressure of the compressed gas in the lower chamber may be equal to or higher than the pressure of the compressed gas in the upper chamber so that the piston section is pressed in a direction to block the orifice.

The valve unit may be operated to discharge the high pressure compressed gas stored in the lower chamber to the outside in response to the fire detection signal input from the outside, and when the valve unit is opened in response to the fire detection signal, the high pressure compressed gas stored in the lower chamber is discharged to the outside so that the pressure of the compressed gas in the upper chamber relatively increase compared to that of the lower chamber, to allow the piston section to be pushed down to open the orifice and the injection hole.

The valve unit may include: a hollow valve housing in which one end thereof is fixed to a lower opening of the lower chamber, a through hole is formed in a side portion thereof, and a valve seat having a gas injection hole is coupled to a lower side thereof, an actuator including an annular cod attached to an inner main surface of the valve housing and an armature surrounded by the cod a poppet valve including a pintle coupled to the armature of the actuator and a valve ball on a bottom side of the pintle to open or close the gas injection hole, and an elastic body disposed between the armature and the valve housing to provide an elastic force so that the poppet valve is pressed in a direction to close the gas injection hole.

The dual-chamber fire extinguisher may further include a manual opening unit operated to artificially move the poppet valve to an open position.

The manual opening unit may include: a manual opening lever hinge-coupled to a pivot bracket mounted on a lower exposed surface of the valve unit; and a manual opening pin operated to push up the poppet valve or armature to open the gas injection hole when the manual opening lever is manipulated to move to the open position.

The extinguishing agent may be filled to a predetermined height in the upper chamber above the orifice and a high pressure compressed gas is filled in the remaining sealed space of the upper chamber above the extinguishing agent.

The inner main surface of the cylinder section under the orifice may be formed in a two-stage stepped structure in which an inner diameter thereof gradually increases as it goes down, and the piston section is formed in a shape corresponding to the two-stage stepped structure for engagement therewith.

A first gasket may be provided to seal a gap between a cylinder end part partitioning the orifice and an upper portion of the piston section, and a second gasket may be provided to seal a gap between an inner stepped portion of the cylinder section formed by the two-stage stepped structure and a lower portion of the piston section.

A damping member may be disposed around a surface of the valve unit facing the piston section or the valve unit inside the lower chamber facing the piston section.

According to the present disclosure, the upper and lower chambers are completely isolated by the piston section disposed in the middle cylinder section, so that the inflow of the extinguishing agent stored in the upper chamber into the lower chamber can be completely blocked. Therefore, when the valve unit is opened, the piston section can be quickly moved to the open position without any resistance, thereby effectively extinguishing an explosive fire or the like at an early stage by rapidly discharging the extinguishing agent.

In addition, with the structure that minimizes the flow resistance in the process of discharging the fire extinguishing agent by configuring the injection hole on the side wall of the cylinder section in which the piston section is disposed, the extinguishing agent can be discharged more quickly, the degree of freedom in design for the injection hole can be increased since sufficient area for the formation of the injection hole can be secured, and the injection holes can be arbitrarily arranged in the circumferential direction on the wall surface of the cylinder section, so that the injection direction of the extinguishing agent can be set at any angle up to 360 degrees.

Further, since the extinguishing device can be operation in a combined solenoid-type electric and manual manner, even in a situation in which the valve unit is not normally driven due to a power failure in the event of fire or the like, the extinguishing device can be manually operated, so that an inoperability problem due to a power failure or the like can also be solved. As a result, it is possible to improve the safety and convenience of the extinguishing device.

BRIEF DESCRIPTION OF THE DRAWINGS

The above and other objectives, features and advantages of the present disclosure will be more clearly understood from the following detailed description when taken in conjunction with the accompanying drawings, in which.

DETAILED DESCRIPTION OF THE INVENTION

Figure 1:
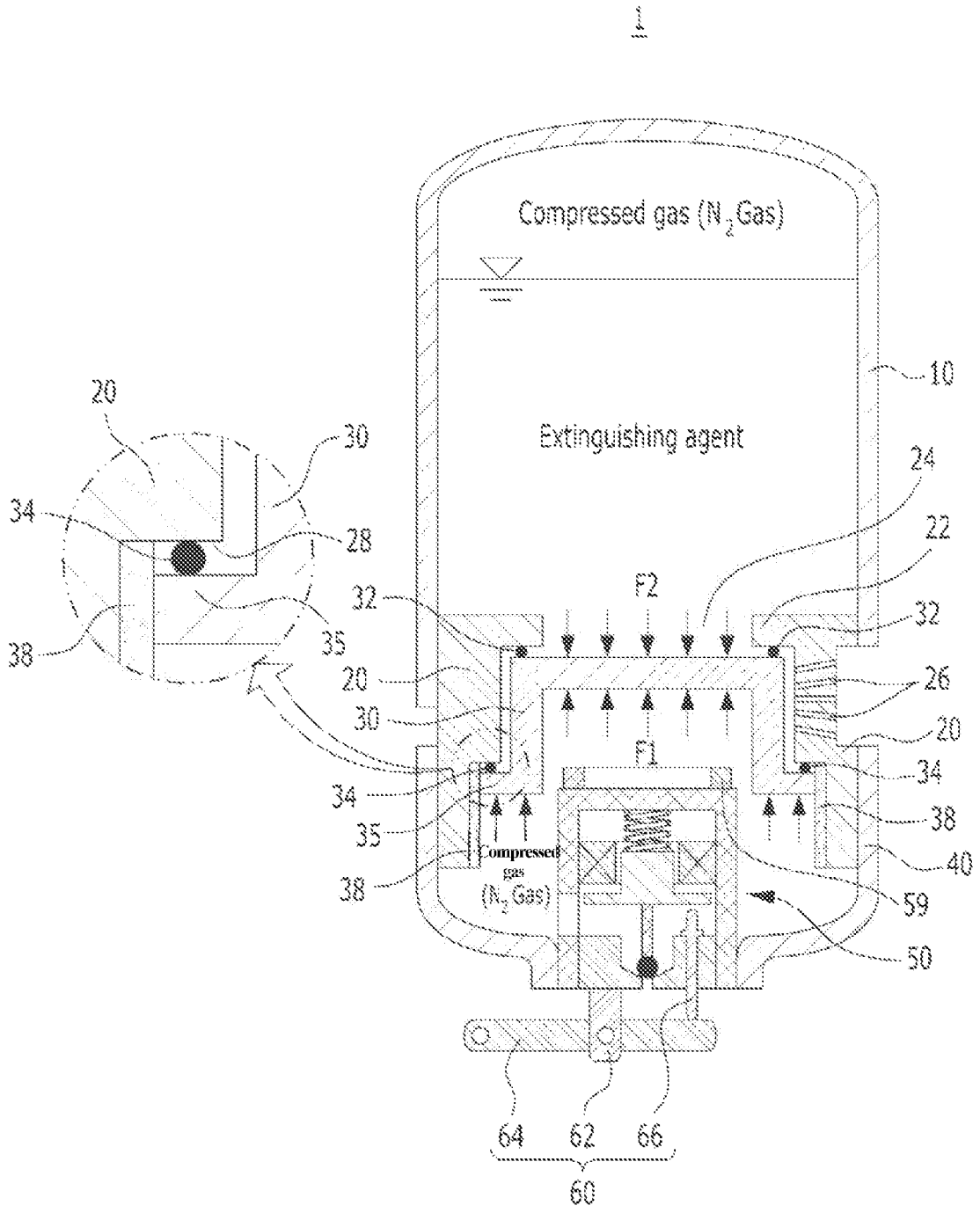
FIG. 1 is a cross-sectional view of an automatic fire extinguishing device in an inactivated state (a valve unit is not opened) according to an embodiment of the present disclosure.

Exemplary preferred embodiments of the present disclosure will be described in detail with reference to the accompanying drawings.

The terminology used herein is for the purpose of describing particular embodiments only and is not intended to limit the disclosure. As used herein, the singular forms "a", "a" and "the" are intended to include the plural forms as well, unless the context clearly indicates otherwise.

It will be further understood that the terms "comprises" and/or "comprising," or "includes" and/or "including," when used in this specification, specify the presence of stated features, integers, steps, operations, elements, components, or combinations thereof but do not preclude the presence or addition of one or more other features, integers, steps, operations, elements, components, or combinations thereof.

It will be understood that although the terms "first," "second," "third" etc. may be used herein to describe various elements, these elements should not be limited by these terms. These terms are only used to distinguish one element from another element.

In addition, terms such as " . . . part". " . . . unit", and " . . . module" described in the specification mean a unit that processes at least one function or operation, which may be implemented by hardware, software or a combination of hardware and software.

In the description with reference to the accompanying drawings, the same reference numerals will be assigned to the same components, and a repeated description thereof will be omitted. In the following description, it is to be noted that, when the functions of conventional elements and the detailed description of elements related with the present disclosure may make the gist of the present disclosure unclear, a detailed description of those elements will be omitted.

Figure 2:
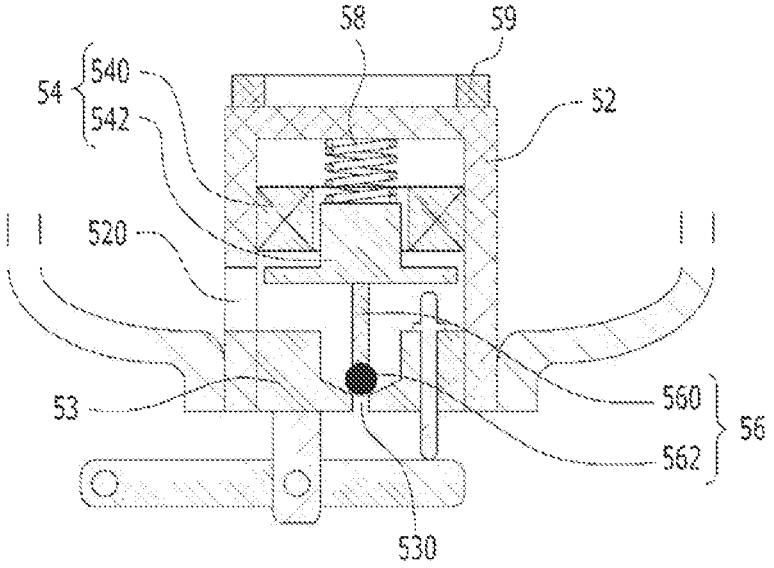
FIG. 2 is an enlarged view of the valve unit illustrated in FIG. 1.

FIG. 1 is a cross-sectional view of an automatic fire extinguishing device in an inactivated state (a valve unit is not opened) according to an embodiment of the present disclosure, and FIG. 2 is an enlarged view of the valve unit illustrated in FIG. 1.

Referring to FIGS. 1 and 2, the automatic fire extinguishing device 1 includes an upper chamber 10 in which a storage space is formed with one side thereof opened, and a lower chamber 40 in which a storage space is formed with a side opposite to the upper chamber 10 opened. In addition, a tubular cylinder section 20 having both sides, to which the upper chamber 10 and the lower chamber 40 are connected, respectively, is provided.

The upper chamber 10 and the cylinder section 20, and the cylinder section 20 and the lower chamber 40 may be mutually coupled through, for example, a screw fastening method or welding. That is, the cylinder section 20 is circumferentially provided with external threads on the upper and lower ends thereof, and the upper and lower chambers 10 and 40 are circumferentially provided with internal threads such that the external threads of the cylinder section 20 and the internal threads of the upper and lower chambers 10 and 40 are meshed with each other. Alternatively, after being inserted into the upper and lower chambers 10 and 40 so as to overlap a certain section, the cylinder section may be pipe-welded and coupled to the upper and lower chambers.

Although the coupling structure of the cylinder section 20 and the upper and lower chambers 10 and 40 is illustrated in the drawings as being one composed of the external threads of the cylinder section and the internal threads of the chambers such that the cylinder section is internally inserted into the chambers, the cylinder section may circumferentially have internal threads and the upper and lower chambers may circumferentially have external threads such that the cylinder section is externally inserted into the chambers. Alternatively, in some cases, a configuration in which the upper chamber 10 and the cylinder section 20 are integrally formed is also applicable.

A high pressure compressed gas is stored with a fire extinguishing agent at a predetermined pressure in the storage space of the upper chamber 10, while only a high pressure compressed gas is stored in the storage space of the lower chamber 40. In addition, the cylinder section 20 disposed between the upper chamber 10 and the lower chamber 40 is provided with extinguishing agent injection holes 26 on the sidewall thereof and an office 24 at an inner end thereof on the front side of the injection holes 26 based on a flow direction of the extinguishing agent during discharge of the extinguishing agent.

The extinguishing agent may be stored up to a predetermined height in the lower section of the storage space of the upper chamber 10, and a compressed gas fills the upper section of the storage space in the upper chamber 10, more specifically, the remaining upper space above the extinguishing agent in the storage space. The compressed gas filled in the upper chamber 10 is to intended to help the external release of the extinguishing agent when a valve unit 50 to be described later is opened, and may be preferably carbon dioxide ($CO_2$) or nitrogen ($N_2$) gas.

As an extinguishing agent, a powder type, a liquid type, or a gas may be used.

The injection holes 26 may be formed at regular intervals in an arbitrary region of one sidewall of the cylinder section 20 as illustrated in the drawings. However, the present disclosure is not limited thereto. In some cases, the injection holes 26 may be disposed in the circumferential direction of the wall of the cylinder section 20 such that the injection direction of the extinguishing agent may be configured to be set at an arbitrary angle up to 360 degrees.

A piston section 30 is disposed in the cylinder section 20. The piston section 30 may be installed to be movable in a direction perpendicular to the tube diameter direction of the cylinder section 20 (up-down direction in FIG. 1). The piston section may be operated to completely block the orifice 24, or to open the orifice 24 and the injection holes 26 behind the orifice 24 based on the flow direction of the extinguishing agent during discharge of the extinguishing agent depending on the pressure state of the compressed gas filled in the upper chamber 10 and the lower chamber 40.

Before operation of the fire extinguishing device, the piston section 30 may be kept in close contact with a cylinder end part 22 that partitions the orifice 24 by the pressure of the compressed gas filled in the upper chamber 10 and the lower chamber 40, as illustrated in FIG. 1. Accordingly, before the fire extinguishing device is operated, the storage spaces of the upper chamber 10 and the lower chamber 40 may be separated in a completely isolated manner from each other by the piston section 30.

An inner main surface of the cylinder section 20 under the orifice 24 may be formed in a two-stage stepped structure in which the inner diameter increases step by step as it goes down, and the piston section 30 may have a structure corresponding to the shape of the inner diameter portion of the cylinder section 20 for engagement therewith. Here, before the fire extinguishing device is operated, the pressure of the compressed gas of the upper chamber 10 is applied to the upper surface of the piston section 30, and the pressure of the compressed gas of the lower chamber 40 is applied to the opposite surface (lower surface of the piston section).

Before the fire extinguishing device is operated (the valve unit to be described later is not in operation), the surface of the piston section 30 to which the pressure of the compressed gas of the lower chamber 40 is applied may be larger than the surface of the piston section 30 to which the pressure of the compressed gas of the upper chamber 10 is applied, and the pressure of the compressed gas filled in the lower chamber 40 may be formed to be equal to or slightly higher than the compressed gas pressure of the upper chamber 10. Accordingly, before the fire extinguishing device is operated, the piston section 30 may be pressed in the direction of blocking the orifice 24 so that the piston section is in close contact with the cylinder end part 22.

A first gasket 32 for preventing leakage of the extinguishing agent and compressed gas filled in the upper chamber 10 may be disposed between the cylinder end part 22 and the piston section 30 that partition the orifice 24. In addition, a second gasket 34 for preventing leakage of compressed gas filled in the lower chamber 40 may be disposed between an inner two-stage stepped portion 28 of the cylinder section 20 and the piston section 30.

Preferably, as illustrated in FIG. 1, the first gasket 32 may be disposed between the lower surface of the cylinder end part 22 and the upper surface of the piston section 30, and the second gasket 34 may be disposed between the inner stepped portion 28 of the cylinder section and the piston section 30. Alternatively, although not illustrated, the first gasket may be disposed between the side of the cylinder end part 22 and the side of the piston section 30, and the second gasket may be disposed between the side of the inner stepped portion 28 of the cylinder section and the side of the lower portion of the piston section 30.

The first gasket 32 and the second gasket 34 may be disposed on the piston section 30 or, conversely, may be disposed on the cylinder end part 22 and the inner stepped portion 28, respectively. A tubular piston seal 38 may be disposed on the inner main surface of the cylinder section 20 corresponding to the position of a lower flange 30 of the piston section 30 to block an inflow of the extinguishing agent toward the lower chamber 40 while guiding the piston section 30 when moving in the direction of opening the orifice 24.

Reference numeral 50 denotes a valve unit for discharging compressed gas stored in the lower chamber 40. The valve unit 50 is disposed in the lower chamber 40 to discharge the compressed gas stored in the lower chamber 40 to the outside. The valve unit 50 may be a solenoid-type electric configuration, and may be operated to discharge a high pressure compressed gas stored in the lower chamber 40 to the outside according to a fire detection signal input from the outside.

As illustrated in FIG. 2, the valve unit 50 includes a valve housing 52 and an actuator 54 arranged inside the valve housing 52. In addition, the valve unit also has a poppet valve 56 coupled to the actuator 54.

The actuator 54 includes an annular coil 540 attached to the inner main surface of the valve housing 52 and an armature 542 surrounded by the coil 540, and the poppet valve 56 may b composed of a pintle 560 coupled to the armature 542 and a valve ball 562 at the bottom of the pintle 560.

The valve housing 52 is a hollow body in which one end thereof is fixed to a lower opening of the lower chamber 40 and a through hole 520 is formed in a side portion thereof, and a valve seat having a gas discharge hole 530 is coupled to a lower end thereof. The valve ball 562 at the bottom of the pintle 560 may be operated to open or close the gas dischargeable 530 depending on whether the actuator 54 is driven.

An elastic body 58 may be disposed between the armature 542 constituting the actuator 54 and the valve housing 52. The elastic body 58 has one end and the other end elastically supported on the upper surface of the armature 542 and the surface of the valve housing 52 corresponding thereto, respectively, to provide elastic force so that the poppet valve 56 is pressed in a direction to close the gas injection hole 530. The elastic body may preferably be a compression coil spring.

The valve unit 50 having such a configuration operates according to a ire detection signal to discharge a high pressure compressed gas stored in the lower chamber 40 to the outside. More specifically, when the valve unit 50 is opened, the high pressure compressed gas stored in the lower chamber 40 is discharged to the outside, so that the pressure of the compressed gas in the upper chamber 10 is increased, thereby causing the piston section 30 to be pushed downward so that the orifice 24 and the injection holes 26 are opened and the extinguishing agent is discharged to the outside therethrough.

There may be a situation in which the valve unit 50, specifically, the electric actuator 54, cannot be normally driven due to a power failure caused by a fire. Accordingly, the automatic fire extinguishing device 1 according to an embodiment of the present disclosure may include a manual opening unit 60 in order to enable the device to be operated even through manual operation in preparation for a situation in which the valve unit 50 does not normally operate due to a power failure caused by a fire, etc.

The manual opening unit 60 may be configured to artificially move the poppet valve 56 to the open position. Preferably, the manual opening unit may include a manual opening lever 64 hinge coupled to a pivot bracket 62 mounted on the exposed bottom surface of the valve unit 50, and a manual opening pin disposed on a valve seat 53 and operated to push up the poppet valve 56 or the armature 542 to open the gas injection hole 530 when the manual opening lever (A is manipulated to move to the open position.

Meanwhile, reference numeral 59 denotes a damping member. The damping member 59 is disposed on the surface of the valve unit 50 (the upper surface of the valve housing 52) facing the piston section 30 to prevent a mechanical contact between the piston section 30 and the valve unit 50. According to embodiments, the damping member 59 may be disposed around the valve unit 50 in the lower chamber 40, rather than on the upper surface of the valve housing 52.

More specifically, the damping member ma have an kind of shock-absorbing or alleviating material, such as rubber or a spring without particular limitation so long as it prevents a direct impact of the piston section on the valve unit 50 when the piston section 30 rapidly descends due to pressure imbalance between the compressed gas in the upper chamber 10 and the lower chamber 40 during the opening of the valve unit 50.

Figure 3:
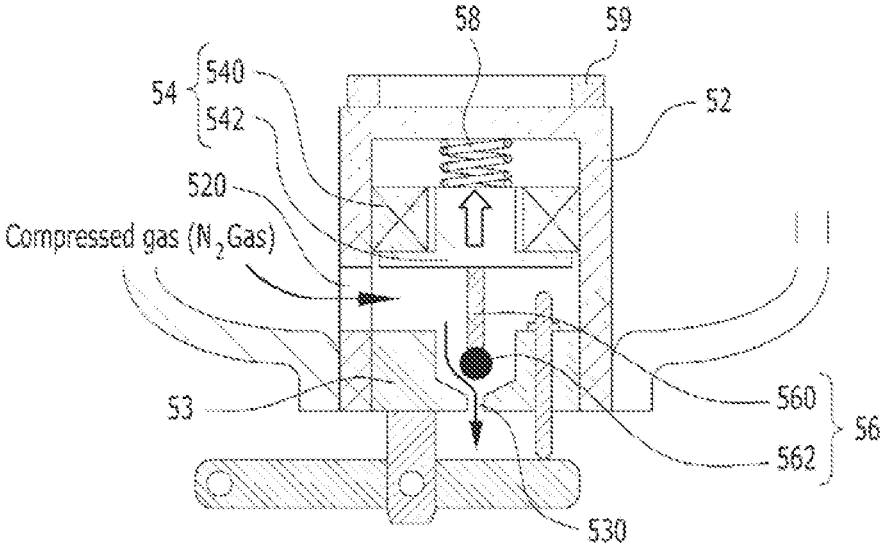
FIG. 3 is an operational state diagram of the valve unit.
Figure 4:
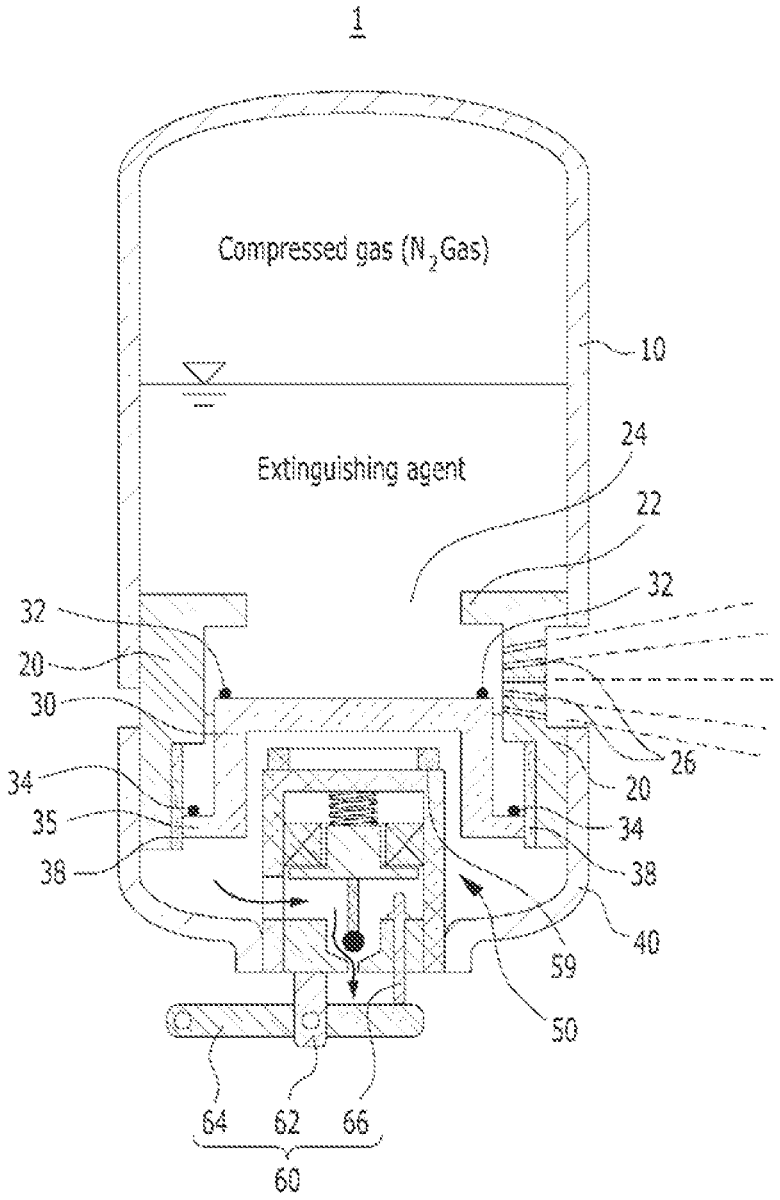
FIG. 4 is a view illustrating an operating state of the automatic fire extinguishing device associated with the operation of the valve unit of FIG. 3.

The operation of the automatic fire extinguishing device according to an embodiment of the present disclosure will be described with reference to FIGS. 3 and 4.

The pressure of the compressed gas filled in the lower chamber 40 is equal to or slightly higher than the pressure of the compressed gas filled in the upper chamber 10, and the area of the lower side of the piston section 30 partitioning the two chambers (the area of the surface of the lower chamber 40 to which the compressed gas is applied) is greater than the area of the upper side of the piston section (the area of the surface of the upper chamber 10 to which the compressed gas is applied). Therefore, the force pushing up the piston section 30 is greater than the force pressing down the piston section 30 (F1>F2, see FIG. 1).

Accordingly, before the automatic fire extinguishing device 1 is operated, the piston section 30 is pressed against and in close contact with the cylinder end part 22, which partitions the orifice 24 of the cylinder section 20, so that the storage space of the upper chamber 10 and the storage space of the lower chamber 40 are completely blocked from each other by the piston section 30. Thus, the extinguishing agent and compressed gas filled in the upper chamber 10 and the lower chamber 40, respectively, are maintained in a completely sealed state (see FIG. 1).

In this state, when a fire is detected by a fire detector so that a current flows through the coil 540, the coil 540 is magnetized, and the poppet valve (FIG. 3) is pushed up due to interaction between the magnetized coil 540 and the armature 542 that is magnetic body so that the valve ball 562 is separated from a valve seat 53. Due to this, the gas injection hole 530 is opened and the compressed gas in the lower chamber 40, which is higher than atmospheric pressure, flows out through the gas injection hole 530.

The pressure of the lower chamber 40 is rapidly reduced due to the outflow of compressed gas through the gas injection hole 530. Due to this, a pressure difference occurs between the upper chamber 10 and the lower chamber 40 to cause the piston section 30 to be pushed toward the lower chamber 40 having a relatively low pressure. Accordingly, the orifice 24 and the injection hole 26 which were blocked are opened as illustrated in FIG. 4, so that the extinguishing agent is discharged to the outside.

Figure 5:
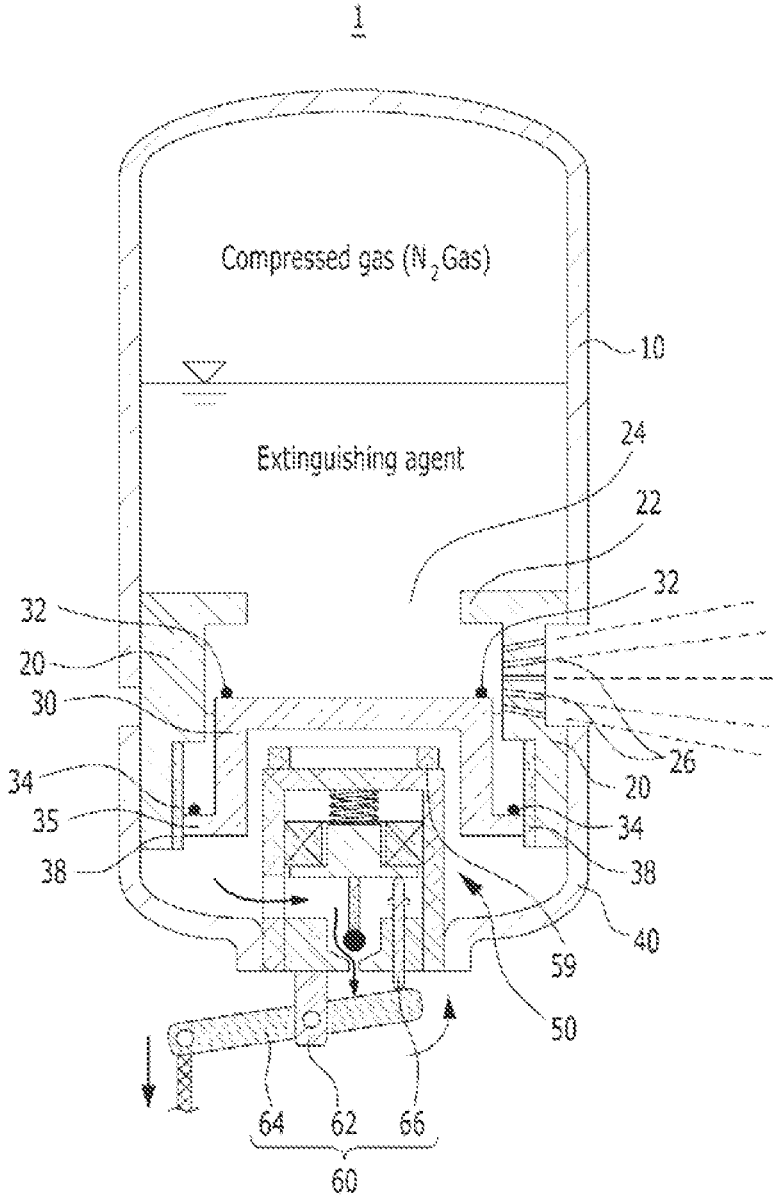
FIG. 5 is a view illustrating a state of the valve unit being manually opened.

The automatic fire extinguishing device 1 according to the present disclosure can be operated not only through electric operation based on a fire detection signal, but also through manual operation. For example, when the electric actuator 54 is in an inoperative state due to a power failure caused by a fire, or when the administrator first detects a fire before the fire detector detects the fire in the early stage of the fire, as illustrated in FIG. 5, quick initial action can be taken by manual operation of the manual opening unit 60 to open the valve unit 50.

According to the embodiment of the present disclosure as described above, the solenoid-type valve unit immediately operates according to the fire detection signal to open the lower chamber to discharge the compressed gas, and the pressure difference between the lower chamber and the upper chamber storing the extinguishing agent occurs to cause the piston section to be pushed down to open the orifice and the injection hole so that the fire extinguishing agent is rapidly discharged, thereby initially and quickly extinguishing a fire.

According to the embodiment of the present disclosure, the upper and lower chambers are completely isolated by the piston section disposed in the middle cylinder section, so that the inflow of the extinguishing agent stored in the upper chamber into the lower chamber can be completely blocked. Therefore, when the valve unit is opened, the piston section can be quickly moved to the open position without any resistance, thereby effectively extinguishing an explosive fire or the like at an early stage by rapidly discharging the extinguishing agent.

In addition, with the structure that minimizes the flow resistance in the process of discharging the fire extinguishing agent by configuring the injection holes on the sidewall of the cylinder section in which the piston section is disposed, the extinguishing agent can be discharged more quickly, the degree of freedom in design for the injection hole can be increased since sufficient area for the formation of the injection hole can be secured, and the injection holes can be arbitrarily arranged in the circumferential direction on the wall surface of the cylinder section, so that the injection direction of the extinguishing agent can be set at any angle up to 360 degrees.

Further, since the extinguishing device can be operation in a combined solenoid-type electric and manual manner, even in a situation in which the valve unit is not normal driven due to a power failure in the event of fire or the like, the extinguishing device can be manually operated, so that an inoperability problem due to a power failure or the like can also be solved. As a result, it is possible to improve the safety and convenience of the extinguishing device.

While the above detailed description illustrates the present disclosure with respect to specific embodiments thereof, it should be understood that the present disclosure is not limited to the specific forms mentioned in the detailed description, but rather includes all modifications, equivalents, and substitutes within the spirit and scope of the present disclosure as defined by the appended claims.

What is claimed is:

1. A dual-chamber fire extinguisher automatically operating in response to a fire detection signal to discharge an extinguishing agent, comprising:

an upper chamber in which a storage space is formed with one end thereof opened, and a lower chamber in which a storage space is formed with one end thereof opened and facing the one end of the upper chamber, wherein the upper chamber stores a compressed gas together with an extinguishing agent and the lower chamber stores a compressed gas, the upper chamber and the lower chamber being isolated from each other;

a cylinder section provided at a position where the opened end of the upper chamber and the opened end of the lower chamber face each other between the upper chamber and the lower chamber, wherein the cylinder section having both end portions which are connected to the upper chamber and the lower chamber, respectively, includes an injection hole for discharging the extinguishing agent on a sidewall thereof, and an orifice prior to the injection hole on the basis of a flow direction of the extinguishing agent during the discharge of the extinguishing agent;

a piston section provided inside the cylinder section and operated to block or open the orifice; and a solenoid-type valve unit provided in a lower opening of the lower chamber and operated to discharge the compressed gas stored in the lower chamber to the outside, wherein the valve unit comprises:

a hollow valve housing in which one end thereof is fixed to the lower opening of the lower chamber, a through hole is formed in a side portion of the hollow valve housing, and a valve seat having a gas injection hole is coupled to a lower portion of the hollow valve housing;

an actuator including an annular coil attached to an inner main surface of the valve housing, and an armature surrounded by the coil;

a poppet valve including a pintle coupled to the armature of the actuator, and a valve ball on a bottom side of the pintle to open or close the gas injection hole; and an elastic body disposed between the armature and the valve housing to provide an elastic force so that the poppet valve is pressed in a direction to close the gas injection hole.

2. The dual-chamber fire extinguisher of claim 1, wherein in a non-operating state of the valve unit, a pressure of the compressed gas in the lower chamber is equal to or higher than a pressure of the compressed gas in the upper chamber so that the piston section is pressed in a direction to block the orifice.

3. The dual-chamber fire extinguisher of claim 1, wherein the valve unit is operated to discharge the compressed gas stored in the lower chamber to the outside in response to the fire detection signal input from the outside, and when the valve unit is opened in response to the fire detection signal, the compressed gas stored in the lower chamber is discharged to the outside so that a pressure of the compressed gas in the upper chamber relatively increase compared to that of the lower chamber, to allow the piston section to be pushed down to open the orifice and the injection hole.

4. The dual-chamber fire extinguisher of claim 1, further comprising a manual opening unit operated to artificially move the poppet valve to an open position.

5. The dual-chamber fire extinguisher of claim 4, wherein the manual opening unit comprises:

a manual opening lever hinge-coupled to a pivot bracket mounted on a lower exposed surface of the valve unit; and a manual opening pin operated to push up the poppet valve or the armature to open the gas injection hole when the manual opening lever is manipulated to move to the open position.

6. The dual-chamber fire extinguisher of claim 1, wherein the extinguishing agent is filled to a predetermined height in the upper chamber above the orifice, and the compressed gas is filled in a remaining sealed space of the upper chamber above the extinguishing agent.

7. The dual-chamber fire extinguisher of claim 1, wherein an inner main surface of the cylinder section under the orifice is formed in a two-stage stepped structure in which an inner diameter thereof gradually increases as the inner main surface goes down, and the piston section is formed in a shape corresponding to the two-stage stepped structure for engagement therewith.

8. The dual-chamber fire extinguisher of claim 7, wherein a first gasket is provided to seal a gap between a cylinder end part partitioning the orifice and an upper portion of the piston section, and a second gasket is provided to seal a gap between an inner stepped portion of the cylinder section and a lower portion of the piston section, which is caused by the two-stage stepped structure.

9. The dual-chamber fire extinguisher of claim 1, wherein a damping member is disposed around a surface of the valve unit facing the piston section or around the valve unit inside the lower chamber facing the piston section.

* * * * *